United States Patent [19]

Izzi

[11] 4,146,939

[45] Apr. 3, 1979

[54] DRAIN FITTING FOR PRE-FORMED OR PRE-ASSEMBLED SHOWERS, ETC.

[76] Inventor: Lewis B. Izzi, 918 Surrey Dr., Shelby, N.C. 28150

[21] Appl. No.: 856,901

[22] Filed: Dec. 2, 1977

[51] Int. Cl.[2] ..... A47K 1/14; E03C 1/26

[52] U.S. Cl. ..... 4/286; 4/288; 4/292

[58] Field of Search ..... 4/286, 287, 288, 289, 4/290, 291, 292

[56] References Cited

U.S. PATENT DOCUMENTS

| | | | |
|---|---|---|---|
| 3,040,895 | 6/1962 | Sisk | 4/286 X |
| 3,071,781 | 1/1963 | Seewack | 4/286 |
| 3,813,708 | 6/1974 | Hamburg | 4/288 |
| 3,896,511 | 7/1975 | Cuschera | 4/288 |
| 3,914,807 | 10/1975 | Palmer | 4/287 |
| 4,034,428 | 7/1977 | Jacuzzi | 4/287 |
| 4,067,072 | 1/1978 | Izzi | 4/288 |

*Primary Examiner*—Henry K. Artis

[57] ABSTRACT

A drain fitting for pre-formed or pre-assembled showers, etc. requiring drainage, having a flanged and internally threaded base connector for the reception of 3 or 4 inch solvent welded drain pipes and which is adapted to have a threaded or bolted connection with a depending strainer barrel having a peripheral flange for engagement with the shower, etc. receptor, the two units clamping a receptor membrane or washers on each edge surface of the receptor opening, and there being recessed channels or slots formed in the strainer barrel threads or clamping ring flange to drain off any leakage or seepage.

4 Claims, 11 Drawing Figures

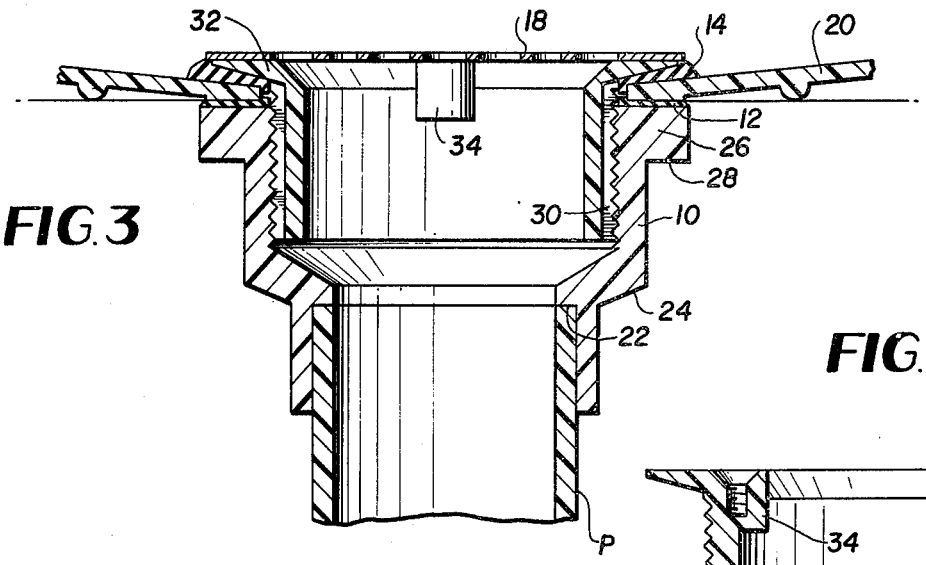
FIG. 3
FIG. 5
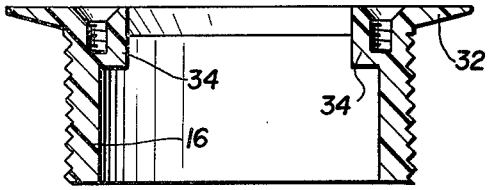
FIG. 6
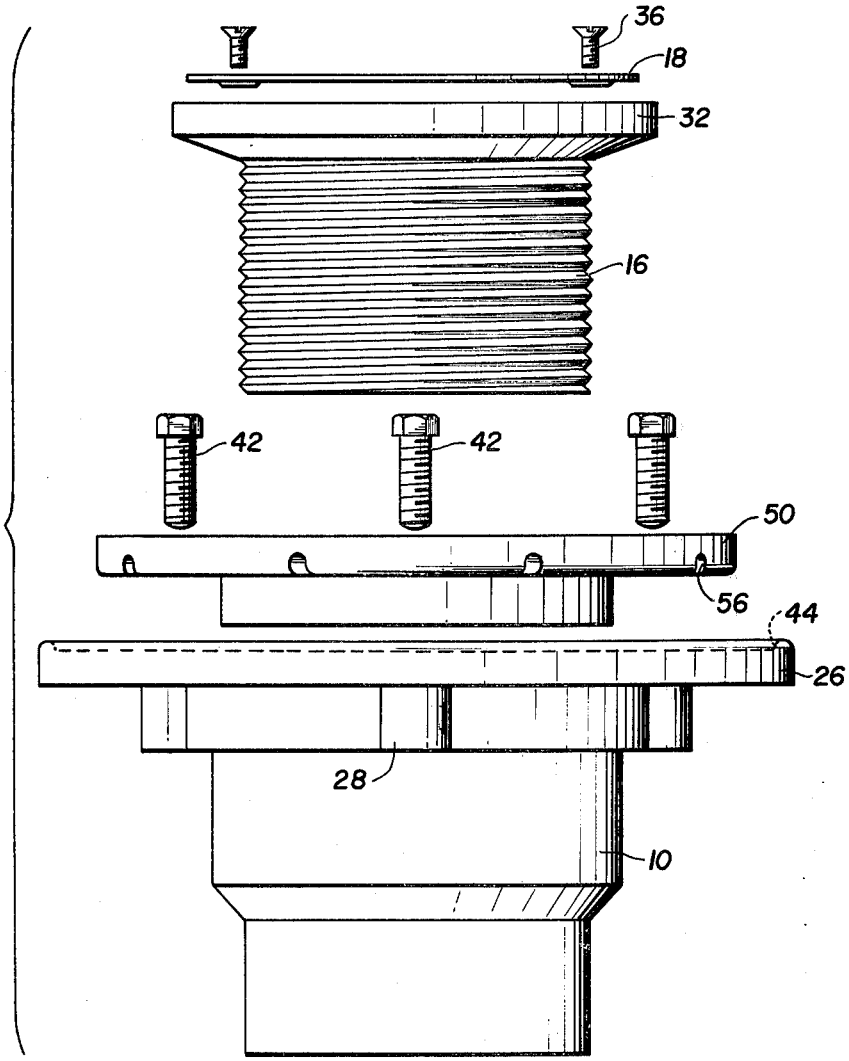

DRAIN FITTING FOR PRE-FORMED OR PRE-ASSEMBLED SHOWERS, ETC.

This invention relates generally to drain structures and more particularly to a drain fitting which may be used with fiberglass or other types of molded, preformed or pre-assembled shower stalls or bases, sinks or tubs, or various similar receptors requiring the use of a drain fitting.

Various types of drain fittings are known in the art and insofar as is known, most of these are characterized by various disadvantageous features. Among these are: the attachment of the drain pipe directly to the strainer barrel to which the strainer plate is attached so that if the upper surface of the receptor is damaged or the gasket needs replacement, the drain pipe would have to be cut and the entire unit removed for repair; the absence of secondary drainage means in the case of leaks or damage; and an excessive cost initially, and in labor and repairs.

Accordingly, the main object of the present invention is to provide an improved drain fitting which will obviate the above and other disadvantageous features.

An important object of the present invention is to provide an improved drain fitting which may be installed in a shower stall receptor or base at the factory, or on the site before or after the receptor is installed.

Another important object of the present invention is to provide an improved drain fitting which provides secondary drainage means for gasket leaks or damage.

A further important object of the present invention is to provide an improved drain fitting in which the strainer barrel portion may be removed from the base connector and the upper surface of the receptor without cutting pipe or going to lower levels of a building, etc. for repair or replacement of the strainer barrel or gasket thus saving material amounts of time and labor.

A still further object of the present invention is to provide an improved drain fitting advantageously formed of plastic so as to be easily and simply installed by solvent welding instead of the time consuming and expensive operation of leading, etc. in conventional units.

Other objects and advantages of the invention will become apparent during the course of the following description.

In the drawings I have shown two embodiments of the invention. In these showings:

FIG. 3 is a central vertical sectional view of the parts in assembled relationship with the receptor, taken on the line 3—3 of FIG. 4;

FIG. 5 is a central vertical sectional view of the strainer barrel showing the threaded recesses for the screws which retain the strainer plate in place;

FIG. 6 is an exploded side elevational view of another embodiment of the invention;

Figure 1:
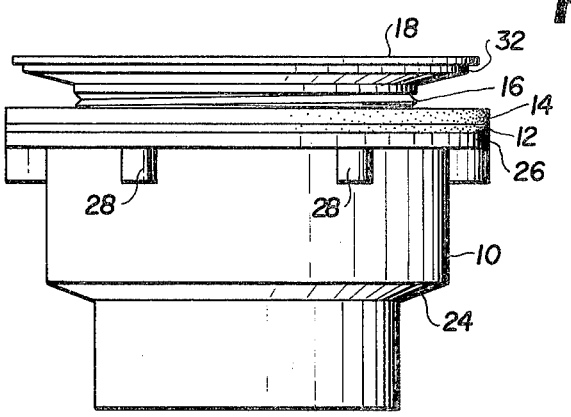
FIG. 1 is a side elevational view of a preferred embodiment of the invention before its installation.
Figure 2:
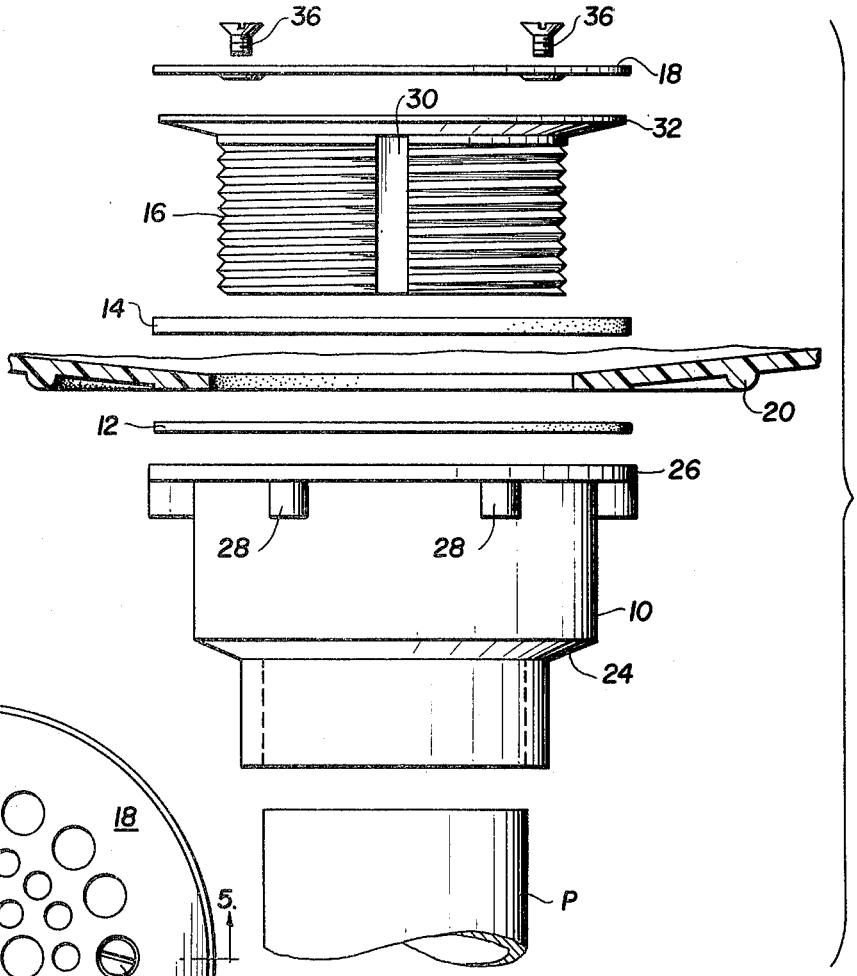
FIG. 2 is an exploded side elevational view showing the relative position of the parts with respect to the receptor and to each other.
Figure 4:
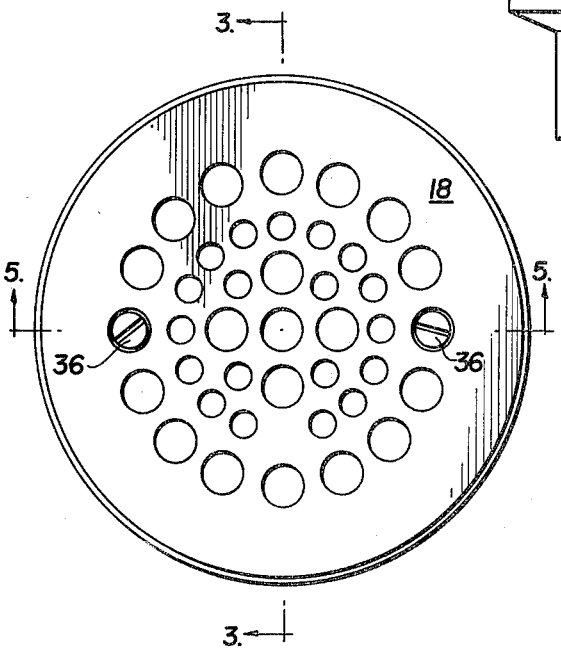
FIG. 4 is a top plan view of the invention showing the strainer plate mounted on the strainer barrel.
Figure 7:
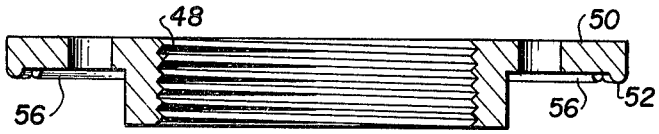
FIG. 7 is a central vertical sectional view of a bolt-down clamping ring which is interiorly threaded to receive the strainer barrel.

As shown in FIGS. 1–5 inclusive, the drain fitting comprises a base connector 10, a pair of gaskets 12 and 14, a strainer barrel 16, and a strainer plate 18, all adapted when in operative position in a receptor 20 to comprise an improved, long-lasting device of ready maintenance.

As will appear, the strainer assembly which is exposed to daily use and is more subject to damage may be replaced or repaired without cutting pipes, going to lower levels, or removing parts of the structure for repair or replacement from beneath the receptor. The drain fitting design is produced by molding, casting, etc. of a suitable plastic which may be utilized with fiberglass or various other types of molded, preformed receptors or openings in shower stall bases, etc.

The base connector 10 is readily solvent welded to plastic DWV pipe P of various materials and as shown, fits 2 or 3 inch pipe for seating either of which positive stops in the form of shoulders 22 and 24 are respectively provided. The base connector 10 is interiorly threaded and is provided with an upper peripheral flange 26 for the support and compression of the gasket 12, and is provided thereunder with a plurality of spaced lugs 28 for engagement by a wrench.

The strainer barrel 16 is exteriorly threaded and includes a plurality of circumferentially spaced, recessed slots 30 therein to provide secondary drainage into the pipe P instead of to lower areas in the structure in the event that either gasket 12 or 14 is damaged or deteriorates. The barrel 16 is also provided with a peripheral flange 32 which compresses the washer 14 against the receptor 20, and with inner diametrically positioned circular threaded bosses 34 which are counter sunk for reception of anti-corrosion screws 36 to enable flush mounting of the strainer plate 18.

Thus, the drain fitting of the present invention provides a base connector 10 for a welded connection to a drain pipe P which is installed beneath the receptor 20 and allows the strainer assembly 16, 18 which is threaded into the base connector to be removed from above the receptor. This is an important feature of the invention.

Another embodiment of the invention is shown in FIGS. 6–11 inclusive wherein like parts have been given like numbers. The essential difference between this and the preceding embodiment is that instead of screwing the base-connector and strainer barrel assembly together to compress the washers 12 and 14 against the receptor 20, a clamping ring is provided for the purpose in order to eliminate any possibility that the liner or waterproof membrane employed is crimped or wrinkled during installation.

The upper surface of the base connector 10 (FIGS. 6–11 inclusive) is provided with four spaced and threaded bolt holes 40 for the reception of headed bolts 42 and with a peripheral upstanding rib 44 on the flange 26. Intermediate the bolt receiving hole 40 and the rib 44 is a circular groove 46.

Figure 8:
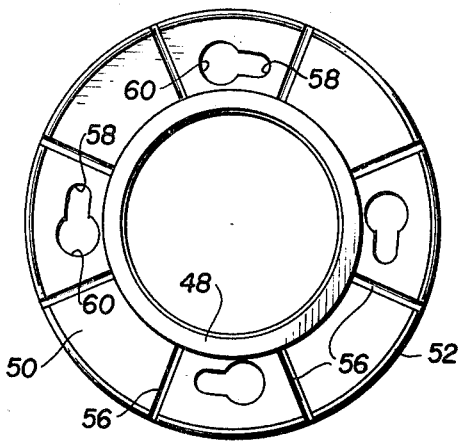
FIG. 8 is a bottom plan view thereof.
Figure 9:
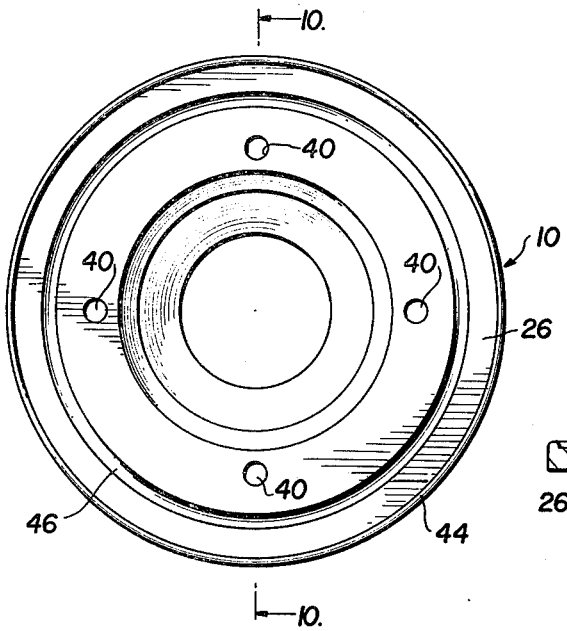
FIG. 9 is a top plan view of the base connector.
Figure 10:
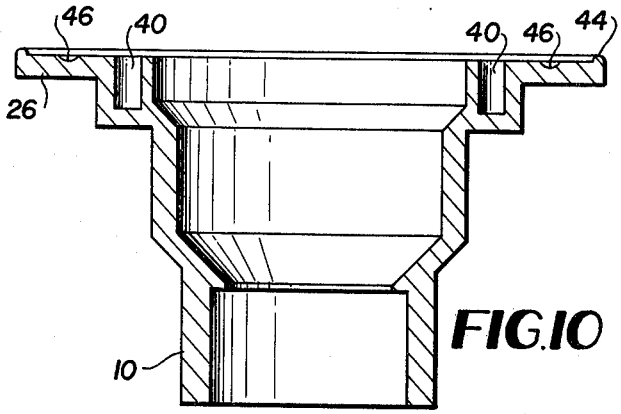
FIG. 10 is a vertical sectional view thereof, taken on the line 10—10 of FIG. 9.
Figure 11:
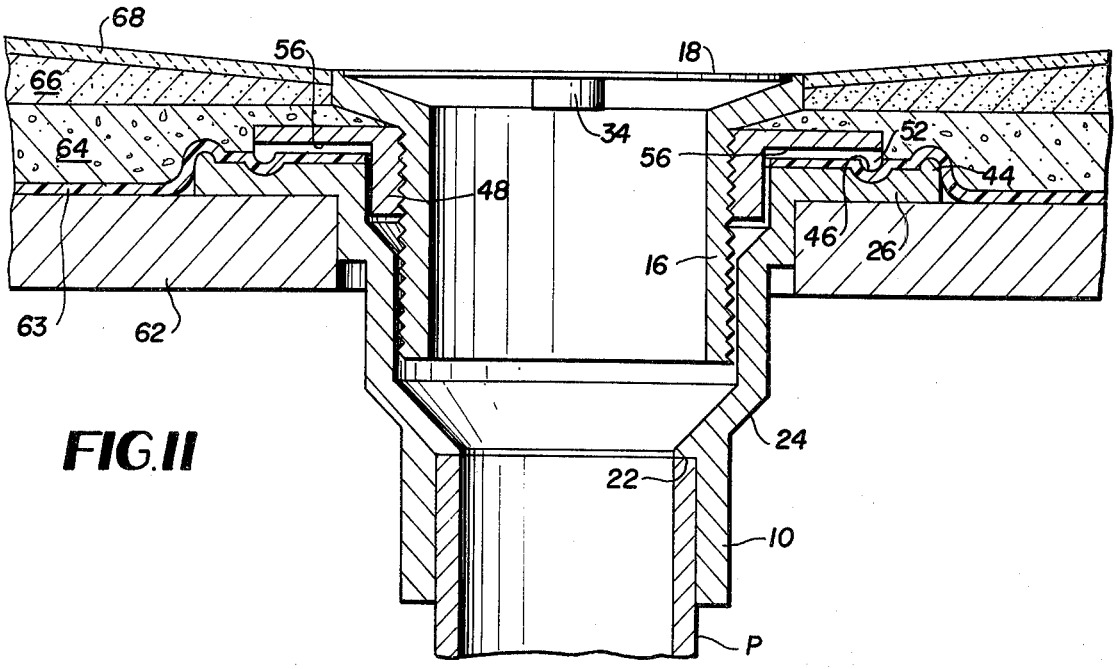
FIG. 11 is a central vertical sectional view of the parts assembled in operative position on a shower stall base, etc.

A bolt clamping ring 48 is interiorly threaded for mounting on the strainer barrel 16 (which is unchanged), and is provided with a flange 50 having a depending peripheral rib 52. This rib 52 (FIG. 11) cooperates with the groove 46 of the base connector 10 to sealingly clamp a waterproof membrane 54 therebetween. As seen in FIG. 8, the bolt clamping ring 48 is also provided with radial, secondary drainage channels 56 and bolt receiving holes 58. One end of each of the holes 58 is enlarged as at 60 to permit passage of the heads of the bolts 42.

In a typical installation of this embodiment of the drain fitting (FIG. 11) where the receptor comprises a liner or waterproof membrane 63 supported by subflooring 62, the base connector 10 is inserted through the receptor opening from above and is solvent welded to the top end of a drain pipe P which abuts one of the shoulders 22, 24 depending upon its diameter.

The flange 26 of the connector rests upon the subflooring 62 and the waterproof membrane 63 is now positioned thereon and closely encircles the 4 bolts 42.

The clamping ring 48 is now positioned over the bolt heads by the bolt hole portions 60, and the ring is turned to move the bolts into the hole portions 58 and the bolts are tightened so that the clamping rib 52 tightly clamps the waterproof membrane 63 into the base connector groove 46 to effect a seal, the washers 12 and 14 being dispensed with. The strainer barrel 16 and its drain plate 18 are now screwed down into the clamping collar 48 to define the drain level of the installation. Thereafter the cement 64 is poured onto the membrane 63, the tile setting bed 66 is positioned and the tile then positioned thereon.

It will be noted that if for any reason, any moisture penetrates the installation, it will pass inwardly by means of the drainage channels 56 and downwardly between the clamping collar 48 and the base connector 10 into the drain pipe P. The secondary drainage channels provided by both embodiments are an important feature of the invention in preventing leakage damage and resultant repairs.

It is to be understood that the forms of my invention herewith shown and described are to be taken as preferred examples of the same and that various changes in the shape, size and arrangement of parts may be resorted to without departure from the spirit of the invention or the scope of the subjoined claims.

What is claimed is:

1. A drain fitting for connecting the drainage opening or receptor of shower stalls, etc. with a drain pipe comprising, in combination, a base connector having a lower shouldered portion to be mounted on the upper end of a drain pipe closely adjacent the receptor and a flanged, upper portion; a drainage barrel having a peripheral flange insertable into said upper portion; a drainage plate mounted on said barrel; means connecting said base connector and said barrel so as to force the flanges thereof into sealing engagement with the edges of the receptor; said connecting means comprising relatively rotatable mating threaded portions; and vertical slots formed in one of said threaded portions to provide secondary drainage means to the drain pipe.

2. A drain fitting for connecting the drainage opening or receptor of shower stalls, etc. with a drain pipe comprising, in combination, a base connector having a lower shouldered portion to be mounted on the upper end of a drain pipe closely adjacent the receptor and a flanged, upper portion; a drainage barrel having a peripheral flange insertable into said upper portion; a drainage plate mounted on said barrel; and means connecting said base connector and said barrel so as to force the flanges thereof into sealing engagement with the edges of the receptor; said connecting means comprising headed bolts mounted in said base connector, and a flanged clamping ring having interior, barrel-receiving threads and bolt-receiving openings therein for clamping the flange of said ring to said connector.

3. The combination recited in claim 2 wherein radial channels are formed in the bottom of said clamping ring flange to provide secondary drainage means to the drain pipe.

4. The combination recited in claim 2 wherein the upper surface of said base connector is provided with a circular groove and said lower face of said clamping ring is provided with a depending circular rib for clamping a waterproof membrane therebetween.

* * * * *